United States Patent [19]

Mazzanti

[11] Patent Number: 4,850,562

[45] Date of Patent: Jul. 25, 1989

[54] HANGER-RETAINING CLAMP FOR GARMENT BAGS

[75] Inventor: Rino Mazzanti, Bologna, Italy

[73] Assignee: Lenox Incorporated, Lawrenceville, N.J.

[21] Appl. No.: 163,642

[22] Filed: Mar. 3, 1988

[51] Int. Cl.[4] ..... A47F 5/00

[52] U.S. Cl. ..... 248/316.1; 24/460; 24/513; 24/521; 211/89; 211/124; 206/291

[58] Field of Search ..... 248/316.1, 316.5, 316.6, 248/317.7; 24/460, 513, 515, 521; 211/89, 124; 206/289, 290, 291, 293, 279

[56] References Cited

U.S. PATENT DOCUMENTS

| | | | |
|---|---|---|---|
| Re. 31,075 | 11/1982 | London et al. . | |
| 341,365 | 5/1886 | Wilson . | |
| 743,454 | 11/1903 | Cohn . | |
| 1,114,775 | 10/1914 | Larson . | |
| 1,436,108 | 11/1922 | Owens . | |
| 1,604,717 | 10/1926 | Pflantzer . | |
| 1,630,031 | 5/1927 | Rogers . | |
| 1,835,632 | 12/1931 | Buhrke . | |
| 1,948,019 | 2/1934 | Ballentine | 206/287 |
| 2,352,102 | 6/1944 | Johnston . | |
| 2,479,634 | 8/1949 | Marques et al. . | |
| 2,545,211 | 3/1951 | Platt | 206/282 |
| 2,551,515 | 5/1951 | Tschirf . | |
| 2,689,631 | 9/1954 | Marks . | |
| 3,221,848 | 12/1965 | O'Neil . | |
| 3,531,835 | 10/1970 | Paikin . | |
| 3,542,170 | 11/1970 | Biale . | |
| 3,566,456 | 3/1971 | London | 206/279 |
| 3,958,675 | 5/1976 | Rosenblum . | |
| 4,046,363 | 9/1977 | Whitley . | |
| 4,139,102 | 2/1979 | Winton . | |
| 4,252,220 | 2/1981 | London et al. | 206/287 |
| 4,266,705 | 5/1981 | Wheeler . | |
| 4,363,388 | 12/1982 | London et al. | 206/287 X |
| 4,618,058 | 10/1986 | Gregg et al. | 206/291 |
| 4,640,414 | 2/1987 | Mobley et al. | 206/279 X |
| 4,732,270 | 3/1988 | Myers et al. | 211/214 X |
| 4,753,342 | 6/1988 | Polichino, Jr. et al. | 248/316.1 X |
| 4,769,878 | 9/1988 | Liao | 211/124 |
| 5,613,766 | 6/1986 | Crawford . | |

FOREIGN PATENT DOCUMENTS

| | | |
|---|---|---|
| 2533647 | 2/1977 | Fed. Rep. of Germany . |
| 2949339 | 6/1981 | Fed. Rep. of Germany . |
| 61-160616 | 7/1986 | Japan . |
| 517893 | 2/1940 | United Kingdom . |
| 1122257 | 8/1968 | United Kingdom . |
| 1280620 | 7/1972 | United Kingdom . |

*Primary Examiner*—Ramon O. Ramirez

*Attorney, Agent, or Firm*—Steele, Gould & Fried

[57] ABSTRACT

A clamp for retaining garment hangers in garment bags has rigid frame in the shape of a "C" with a top leg, a rear leg and a bottom leg, the top leg and bottom leg being spaced from one another to admit hangers to be hung on the bottom leg. The frame is mountable at the top inner wall of a garment bag, for receiving garment hangers by their wire hook ends. An eccentric clamp bar rotatably carried in the frame between the rear leg and a distal end of the top leg is movable manually by a user between an open position wherein an eccentric portion of the clamp bar is spaced from the bottom leg, and a closed position wherein the eccentric protruding part of the clamp bar bears against the bottom leg, clamping the hangers in place. The eccentric clamp bar rotates on an axis in a common plane with the lower leg.

13 Claims, 2 Drawing Sheets

HANGER-RETAINING CLAMP FOR GARMENT BAGS

BACKGROUND OF THE INVENTION

1. Field of the Invention

This invention relates to the field of clamps for garment hangers, for example of the type disposed in the tops of garment bags, for holding in place hangers and their garments as the garment bag is handled during transit. In particular, the invention relates to such a clamp having a rigid frame member upon which the hangers are placed, and a clamp bar, rotatable in the plane of the frame member, with an eccentric protruding portion that can be rotated to bear against the frame member along its length, thereby clamping the hangers in place.

2. Prior Art

The prior art includes many variations of garment bags and other pieces of luggage designed to retain a hanger or the like upon which a garment is placed. The hanger is a wire or other form having a hook at the top, normally to be hooked over a closet rod. When used on garments in luggage, it is desirable that the garment stay on the hanger and the hanger remain stationary as the luggage is handled. However, in practice, garments are prone to slip off the hangers when the hangers are displaced, and the hangers are prone to become displaced and even to slip off the retaining mechanism (if any) provided in garment bags for supporting the hangers when the garment bag is unfolded and hung by its upper end. Accordingly, the prior art has conceived of various retaining means intended removably to retain the hangers. In one type of device, the hanger retaining apparatus requires a special type of hanger, for example having a pivotable hook end which can be rotated downwardly to enable a special retention mechanism. An example of such a hanger is shown in U.S. Pat. No. 2,545,211-Platt. Devices are likewise known for use with hangers of a substantially conventional structure, e.g., having a body portion dimensioned to resemble a person's shoulders, and a central upper wire hook, normally placed over a closet rod or the like.

Notwithstanding extensive efforts to provide special hanger structures, hanger hooks and clamps to retain clothes hangers in the upper portion of garment bags, the hangers still have a way of coming loose or at least becoming displaced, whereupon the user finds his or her garments wadded in the bottom of the garment bag upon arrival at the end of a trip. In attempts to overcome these difficulties, recent garment retaining mechanisms have positively engaged the hanger hook ends to ensure that the hangers will not readily be displaced or disengaged from the hanger retaining means.

Hanger retaining clamps have been proposed in a number of different structural arrangements. These arrangements are typically characterized by a hingeable attachment at one end of two elongated elements forming jaws, with the opposite end having a clasp for holding the jaws closed. U.S. Pat. No. 3,566,456-London teaches a clamp of this type, adapted to engage the shank portion of a hanger just below the closet rod engaging hook. Two elongated jaw members are hinged together at one end via a pin defining a vertical pivot axis, and a clip fixed at the other end to one of the jaws can be rotated around the other of the jaws to hold the hinged jaws together around the hangers and thereby hold the hangers against displacement leading to their falling downward in the garment bag. This arrangement positively captures the hangers when the clamp is closed. However, it can be quite difficult to manipulate hangers onto and off of the clamping mechanism without dropping them, making the clamp only openable as a practical matter when the hangers are hung on a closet bar. Without independent support from a closet bar, the user must be able to hold a plurality of hangers and their garments in position to be clamped and at the same time close and lock the jaws, which can be difficult. As a practical matter, these devices are of limited usefulness except in situations in which the garment hangers are all already hung from a closet bar and a garment bag is wrapped around them in place. Another example of a clamp of this type, characterized by elongated jaw members hinged at one end and locked by locking means disposed at the opposite end, is shown in U.S. Pat. No. 1,948,019-Ballentine.

In other hinged jaw devices, the jaws and hinging axis are rotated ninety degrees compared to London '456 such that one of the two elongated jaw members is rigidly attached at the top inside wall of a garment bag and the other of the jaw members hinges downwardly via a horizontally-oriented hinge axis disposed at the top and rear of the garment bag. As in the London '456 clamp a clasp member is attached to one of the jaws at the front of the mechanism and can engage the other of the jaws for holding the two jaws together against the hangers. In this case the clamp encloses around an uppermost point in the hanger hook rather than on the shank of the hanger.

In providing a hingeable clamp mechanism wherein the lower jaw hinges downwardly, a problem is encountered similar to problems encountered when opening the London '456 clamp. When the clamp clasp is opened to disengage the two jaws, the lower jaw falls away, whereupon the hangers on the lower jaw slide off unless held manually. A user can accommodate this problem by taking care not to open the jaw unless the hangers are otherwise supported. However, due to the fact that the clamp engages the hanger hooks, the hangers cannot be supported thereby on a closet rod.

According to U.S. Pat. Nos. 4,363,388 and 4,252,220, both to London et al., means are provided for limiting the maximum angle at which the jaws can be opened. Therefore, when the clamp is opened the lower jaw slants downwardly from the pivot axis but stays close enough to the upper jaw that a bail-type closure at the distal end of the jaws can be extended across the opening between the jaws to retain the hangers against slipping off the lower jaw. Such a bail closure also, of course, limits the angular opening of the jaws by its own structure. One drawback is that the bail closure interferes with the user's free access to the space between the jaws, needed to insert and remove hangers. Another drawback is that opening the clamp jostles the hangers and their garments as the hanger-supporting lower jaw falls open.

The closure at the distal end of the jaw members spans across the opening of the jaws to draw the jaws closed. This requires a user to manipulate the locking bail or like closure with one hand and to manipulate the lower jaw and the hangers with the other hand. This can be cumbersome. Accordingly, U.S. Pat. No. 4,618,058-Gregg and 4,640,414-Mobley et al. carry this structural concept a step further and teach a closure that is spring biased to open and clear the space between the jaws. Rather than clamp the hangers between a movable lower jaw and a stationary upper jaw as in London '388, London '220 and the like, the Gregg and Mobley patents teach a stationary lower jaw mounted at a space below the top of the garment bag on a rigid C-shaped frame. A movable upper jaw hinged at the back of the C-frame bears downwardly on the hangers as they are placed on the lower jaw. The rigid C-frame is mounted by its upper end at the top of a garment bag. The intermediate movable jaw member is hinged to the rigid frame at a horizontal pivot axis at the rear portion of the rigid C frame, whereby the intermediate jaw member hinges either downwardly against the lower frame member of the C-shaped frame and the hangers thereon, or upwardly away from the hangers. In addition to the rigid C-frame and movable jaw member, a movable locking member is hinged to the front, distal end of the movable jaw member. The locking member also hinges on a horizontal axis and has an eccentric portion that bears from inside the C-frame against the upper leg of the C-frame to force the movable jaw member against the lower C-frame member, thereby clamping the hangers.

By including a spring bias means to force the intermediate movable jaw upwardly whenever the locking member is disengaged, the clamp will remain open and the space above the lower leg of the rigid C-frame is clear for loading or unloading of hangers. Inasmuch as the lower leg of the C-frame is rigidly mounted to the garment bag and forms the primary support structure for the hangers, there is no danger that the hangers will fall off the unit when the clamp is allowed to open. On the other hand, the arrangement has inherent drawbacks. In order to function as described, it is necessary to include all the noted parts, namely, the rigid C-shaped frame, the intermediate movable jaw and the locking member hinged to the intermediate jaw, all of which are hinged together and relatively movable, as well as the spring which biases the intermediate jaw to open. If a user omits the biassing spring, then gravity urges the intermediate jaw closed against the stationary lower jaw, whereby two hands once again are required in order to manipulate the locking clamp.

According to the present invention, the number of moving parts is reduced to a minimum, while retaining the benefits of a stationary rigid C-frame having a lower member for supporting the hangers. According to the invention, it is not necessary to spring bias any hinged jaw member toward an open position and no relatively rotatable locking tab or locking bail blocking access are necessary. These benefits accrue by abandoning the prior art concept of hingeably attaching jaw members by one end and locking them together at their opposite ends to engage the hangers. In place of the elongated hinged-together jaws of the prior art, the invention employs a clamping bar disposed on an axis in the plane of the frame member rather than perpendicular thereto. The clamping bar is rotatable on the axis and has an eccentric protrusion along its length. By rotating the clamping bar such that the eccentric protrusion moves downwardly against the lower leg of the C-frame, the hangers are clamped. By rotating the eccentric of the clamping bar upwardly, the lower leg of the C-frame is cleared for loading or unloading hangers without interference. Unlike Gregg and Mobley, which require a relatively movable locking means on the movable intermediate jaw, the rotatable clamp bar of the invention preferably includes an operating lever rigidly attached to the clamping bar for a user to manually rotate the clamping bar between the closed and open positions. The clamping bar can be provided with a simple stop abutting the C-frame in the closed position, for preventing over-rotation. A detent mechanism operating between a rear end face of the clamping bar and the inside of the rear leg of the C-frame can be included to positively retain the clamping bar in the closed and open positions, respectively.

By replacing hinged jaws with an eccentric clamp, the invention reduces the complexity of the device. The invention also changes the forces on the apparatus in use. The user will exert a force on the eccentric clamp bar tending to rotate the C-frame around its axis adjacent the upper leg. Accordingly, a pair of wing-like supports extend perpendicularly outwards from the upper C-frame leg, including means to securely attach the clamp to a garment bag. The eccentric clamp bar can be journalled at the rear of the rigid C-frame, and preferably is journalled at both the rear and the distal end of the top leg of the C-frame. The journalled (rotatable) connection between the clamp bar and the C-frame at the front or distal end of the top C-frame leg is defined by a yoke that is deformed around a portion of the clamping bar when assembled. The relationship between the clamping bar and the C-frame can be male or female, however, it is preferred that the connection at the rear of the C-frame be defined by a cylindrical integral pin extending from the C-frame, which fits into a complementary opening in the end of the clamping bar.

SUMMARY OF THE INVENTION

It is an object of the invention to employ the benefits of a rigid C-frame construction for a garment hanger clamp while improving the convenience and durability of the clamp and reducing the number of parts needed.

It is another object of the invention to improve the ease of operation of a hanger clamp such that the device can easily be operated with only one hand, including manipulation of the hangers and the locking mechanism.

It is a further object of the invention to reduce the expense of garment hanger clamps while improving their strength.

It is yet another object of the invention to employ an elongated eccentric clamp bar in a garment hanger retaining mechanism, to avoid drawbacks of hinged abutting jaws.

These and other objects are accomplished by a clamp for retaining garment hangers in garment bags having a rigid frame in the shape of a "C" with a top leg, a rear leg and a bottom leg, the top leg and bottom leg being spaced to receive hangers on the bottom leg. The frame is mountable at the top inner wall of a garment bag, for suspending the hangers by their wire hook ends. An eccentric clamp bar rotatably carried in the frame between journalled ends at the rear leg and at a distal end of the top leg is rotatable manually by a user between an open position wherein an eccentric portion of the clamp bar is spaced from the bottom leg, and a closed position wherein the eccentric protruding part of the clamp bar bears against the bottom leg, clamping the hangers in place. The eccentric clamp bar rotates on an axis in a common plane with the lower leg.

BRIEF DESCRIPTION OF THE DRAWINGS

There is shown in the drawings the embodiments that are presently preferred. It should be understood, however, that the invention is not limited to the precise arrangements and instrumentalities shown, and furthermore that the invention is subject to embodiment in other groupings of specific features. The drawings are intended to be illustrative rather than limiting.

DETAILED DESCRIPTION OF THE PREFERRED EMBODIMENTS

Figure 1:
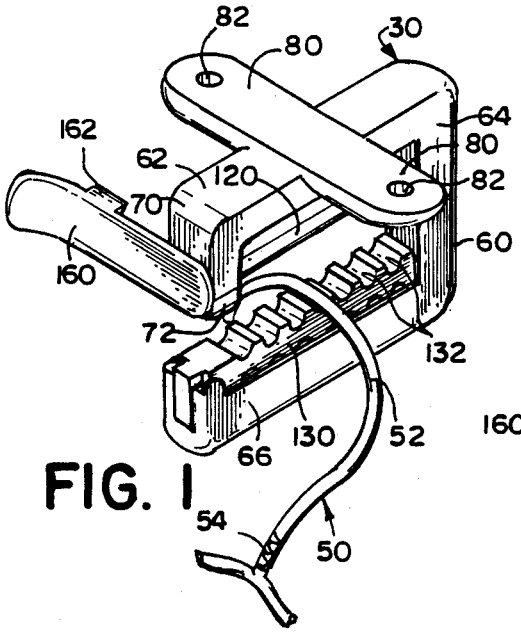
FIG. 1 is a perspective view of the garment hanger clamp of the invention, with a hanger hook shown in place and the clamp bar being rotated open.
Figure 2:
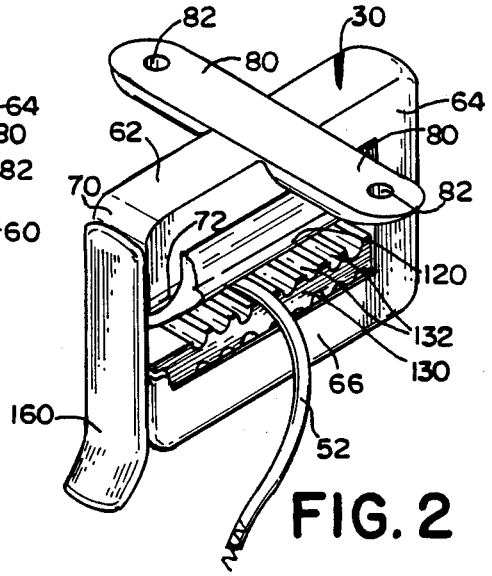
FIG. 2 is a perspective view corresponding to FIG. 1, but with the clamp bar rotated closed.

Clamp 30 is shown generally in FIGS. 1 and 2, in its opened and closed positions, respectively. Clamp 30 comprises a substantially rigid frame 60 in the shape of a "C" and a rotatable clamping bar 120 therein. The "C" shape can be squared as shown or can be rounded, provided a lower frame leg 66 and a space above the lower frame leg are provided. Frame 60 also has means for mounting the clamp to a support, including wings 80 extending out in opposite directions from frame 60 and including attachment means 82, for example rivet holes, for fixing the wings to the top wall of a garment bag or the like. In this manner, garment hangers 50 can be supported in the garment bag by their hooked upper ends 52, the garments being disposed on the hangers at and below shank 54, and a plurality of hangers 50 being supportable on clamp 30.

The C-shaped frame 60 has a top member 62, rear member 64 and bottom member 66, rigidly attached together and to mounting wings 80. These parts can be molded integrally. The bottom leg 66 is provided with a pad 130, for example of rubber or plastic, including a plurality of depressions 132 in which the hooked ends 52 of hangers 50 will reside when placed. The C-shaped frame 60 provides the basic mechanical support for the hangers 50, and must be sufficiently strong to withstand the weight of the hangers and the mechanical forces expeced. The total weight of hangers in the garment bag is not likely to exceed about fifty pounds, however, it is preferred to provide a sufficiently strong frame 60 to withstand at least 200 pounds placed at the distal end of the lower frame member. A sufficiently strong frame member can be made from steel or plastic. Preferably, however, the frame member is cast integrally of a strong and lightweight metal alloy, for example the alloy Zamak, which comprises ninety-five percent zinc, four percent aluminum and one percent copper. The cast alloy frame is also nickel plated. Alternatively, the frame and/or the rotatable clamping bar can be made of a durable plastic.

The clamp 30 is opened and closed by rotating clamp bar 120 by means of finger tab 160, rigidly attached to the rotatable clamp bar 120 at the front. Finger tab 160 can be placed at other locations along bar 120, for example the rear, however, the front placement is most accessible to the user and is always clear of the hooked ends 52 of hangers 50.

Figure 5:
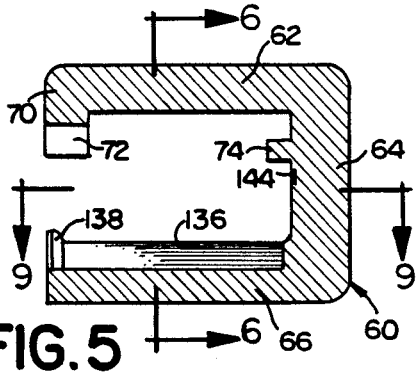
FIG. 5 is a partial section view of a C-frame member according to FIG. 1 or FIG. 2, along the plane of the C-frame.

Clamp bar 120 is journalled to the frame 60 (i.e., rotatably fixed in the manner of an axle in a cylindrical opening) such that bar 120 is rotatable around an axis in the plane of frame 60. Clamp bar 120 has an eccentric protrusion 128 which forms a contacting member that bears downwardly on hooks 52 of the hangers 50 when bar 120 is rotated, counter clockwise in the embodiments shown in FIGS. 1 and 2. Bar 120 can be mounted in a number of alternative ways. For example, the bar 120 can be journalled only at the rear leg 64 of rigid C-shaped frame 60. Alternatively, the bar can be fixed along an intermediate area of the upper frame member 62. Preferably, the rotatable clamping bar 120 is journalled at both the rear frame leg 64 and the distal end 70 of upper frame member 62. In particular, a cylindrical opening in one of the rear end of clamping bar 120 and the rear leg 64 of the frame, receives a pin 74 extending from the other. Pin 74, shown in FIG. 5, is preferably an integral protrusion of the rear leg 64, and thus adds to the strength of the rear leg rather than weakening it as would a hole in leg 64 (for receiving a pin extending from the bar 120). Due to the leverage exerted by a weight such as a heavy garment hung at the extreme end of the lower leg 66 of frame 60, rear leg 64 is preferably substantially solid.

Figure 3:
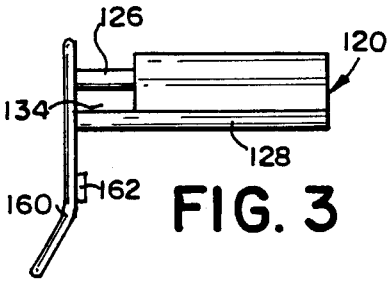
FIG. 3 is a side elevation view of a clamping bar apart from the C-frame.
Figure 4:
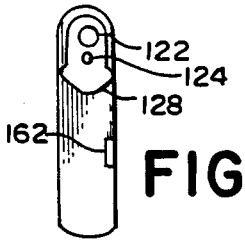
FIG. 4 is an end elevation view taken from the right in FIG. 3.

Clamping bar 120 is rotatably fixed to the distal end 70 of upper leg 62 of frame 60 by means of a yoke member defining a partial enclosure for an axle-like segment 126 at the front of clamp bar 120, compressed after assembly. Clamp bar 120 is shown separate from clamp 30 in FIG. 3. Bar 120 is preferably an integrally molded arrangement including an eccentric contacting member 128 facing downwardly towards the lower leg 66 of frame 60 when the apparatus is closed as shown in FIG. 2, and rotatably movable away from lower leg 66 when the device is open as shown in FIG. 1. Axle member 126 of bar 120 defines the axis of rotation, the axle 126 being spaced from the contacting member 128 by space 134, into which the two ends of yoke 72 are bent during assembly. Finger tab 160 extends eccentrically from axle portion 126, for manual manipulation of the clamping bar 120. A stop 162 prevents over-rotation of the clamping bar from the closed position shown in FIG. 2 because stop 162 abuts lower leg 66 of frame 60 when bar 120 is rotated closed.

At the distal end 70 of the upper leg 62 of frame 60, yoke 72 preferably has a pair of downwardly extending tabs to be deformed around the axle portion 126 of clamp bar 120 during assembly of the device. Other arrangements are possible for axially fixing bar 120 between the distal end 70 and rear leg 64 of C-shaped frame 60, and allowing rotation of bar 120 in place. For example, a single tab rather than the two tabs of yoke 72 can be bent around axle 126.

In addition to tab 162, which fixes clamp bar 120 against over-rotation, a detent mechanism is preferably employed to retain bar 120 in at least one desired angular position, for example open. It is possible to sufficiently tightly clamp axle portion 126 in yoke 72 such that the clamp bar 120 will remain at the angular position where it was last placed by the user. Preferably, however, yoke 72 does not restrict free rotation of clamp bar 120 and instead a resilient detent is defined for retaining clamp bar 120 at least in an open position and preferably both in an open position and in a closed position.

Figure 6:
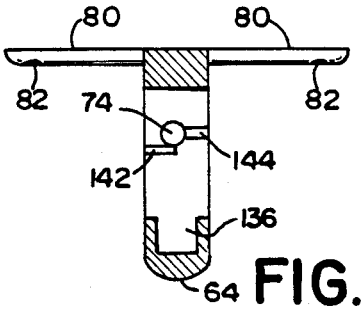
FIG. 6 is a section view taken along lines 6—6 in FIG. 5.
Figure 7:
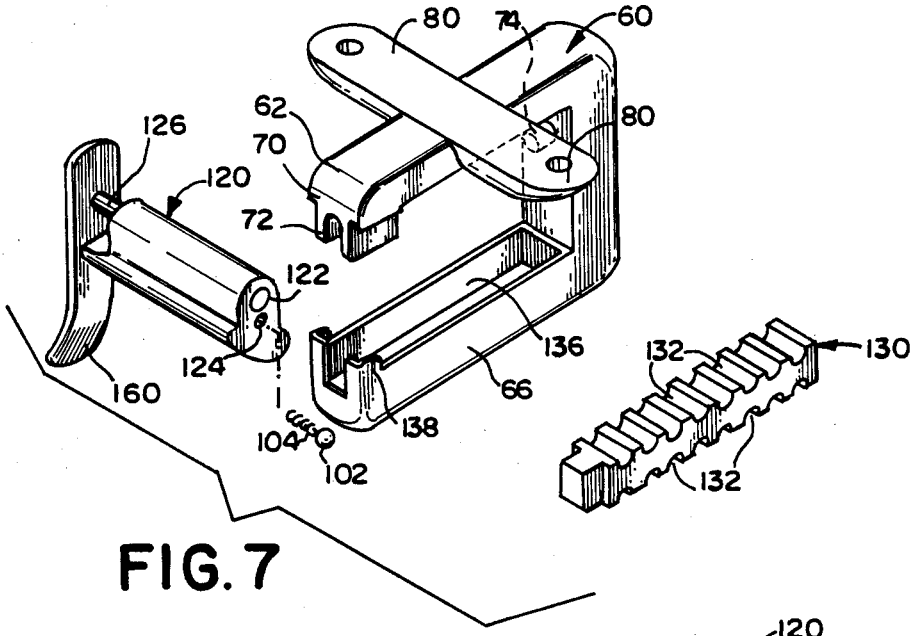
FIG. 7 is an exploded perspective view showing the respective parts of the clamp of the invention.

As shown in FIG. 7, the rear face of clamp bar 120 is provided with a hole 122 that rotatably receives pin 74 extending from rear leg 64 of frame 60. An eccentric opening 124 off the axis defined by pin 74 and hole 122 is arranged to receive a detent pin or ball 102, and a resilient means such as helical spring 104 is disposed in opening 124 behind ball 102. Spring 104 and then ball 102 are pushed into hole 124 upon assembly of bar 120 in frame 60, whereupon ball 102 is urged by pressure of spring 104 against the inward facing wall of leg 64 of frame 60. A pair of depressions 142, 144 are defined in the inward-facing wall of leg 64, at desired positions. When ball 102 drops resiliently into depression 142, 144, clamp bar 120 is retained in position. The illustrated detent depressions 142, 144 are used when the bar is closed and opened, respectively. Depressions 142, 144 are shown in FIG. 6. The depressions can be formed by shallow slots extending inwardly from the sides of the C-frame rear leg 64. The slots should be deep enough to provide a secure detent, but not so deep that ball 102 extends far out of hole 124 in bar 120. Preferably, about half the diameter of ball 102 remains in hole 124 when ball 102 is fully advanced into detent depressions 142, 144.

Finger tab 160 closes the space between the distal ends of the upper leg 64 and the lower leg 66 of frame 60. It is not necessary to proper operation that tab 160 close this space, because even without tab 160, the clamping bar 120 by its eccentric projection 128 will bear downwardly on hanger hooks 52, causing them to be securely clamped in depressions 132 on resilient pad 130.

Figure 9:
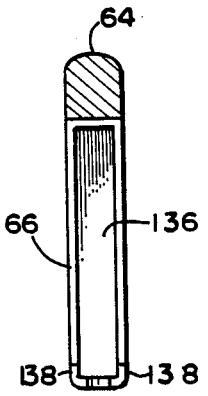
FIG. 9 is a section view taken along lines 9—9 in FIG. 5.

Resilient pad 130 is shown in the exploded view of FIG. 7. The extreme forward end of pad 130 is narrower than the remainder of pad 130, particularly in the area of depressions 132. This permits pad 130 to become locked in place when inserted in channel 136, defined in the lower leg 66 of frame 60. Pad 130 cannot be displaced forwardly when the hangers are pulled forward. A pair of locking ears 138 are provided on the distal end of lower leg 66, and as shown in FIG. 9 ears 138 define a narrower spacing than that of the remainder of channel 136. The narrowing at the front end of the clamp retains pad 130 in place. It is also presently preferred that pad 130 be adhesively fixed in channel 136 as well.

Pad 130 need not be provided on the lower leg 66 of frame 60. It is also possible to arrange a resilient member on the eccentric protrusion 128 of clamping bar 120. Whether a resilient means is provided on leg 66, protrusion 128 or both, the result is that when bar 120 is rotated into the locked position as shown in FIG. 2, eccentric portion 128 comes into contact with the upper contact face of the lower frame leg. Resilient material on either member resiliently engages around the hooks 52 of hangers 50.

Figure 8:
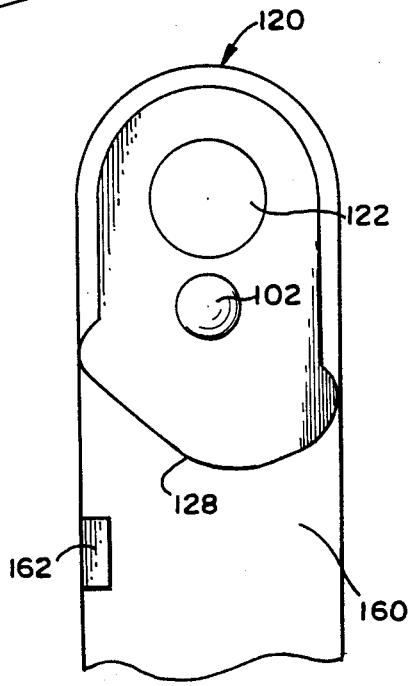
FIG. 8 is an enlarged end view of the rotatable clamping bar corresponding to FIG. 4 and showing in detail the eccetric protrusion of the clamping bar.

As shown in FIG. 8, the eccentric protrusion 128 is preferably not symmetrical around a center line of the axis defined by hole 122, pin 74 and yoke 72. Instead, eccentric protrusion 128 has a leading contour of a relatively low curvature, toward the left in FIG. 8, and a trailing contour of a relatively higher curvature. In this manner, less pressure is exerted on pad 130 as the clamp bar 120 is rotated from its most open position downwardly, and near the point at which tab 162 contacts the outer edge of frame 60 adjacent locking ear 138, the curvature is such that more pressure is exerted. The user gets a secure feeling of locking due to the buildup of pressure between protrusion 128 and pad 130, and not only due to the detent pin 102 falling into locking groove 142. The clamp or "trolley" clamp as so described is very easy to operate because it has only one required moving part, i.e., the clamp bar 120. The user easily rotates this part open or closed by means of finger tab 160, readily accessible at the front. Operation is so convenient that the user can open or close the clamp while holding hangers. Nevertheless, the hangers are securely clamped when the device is closed and are carried securely on leg 66 at all times.

The clamp is subject to a number of further variations that should now become apparent to persons skilled in the art aware of this disclosure. Reference should be made to the appended claims rather than the foregoing specification as indicating the true scope of the invention.

What is claimed is:

1. A clamp for retaining hangers, comprising:

a rigid frame member having a top leg, a rear leg and a bottom leg defining a general C-shape with a space between the top leg and the bottom leg, the top leg, rear leg and bottom leg all occupying a common plane;

means for mounting the frame to a support such that the bottom leg is spaced below the top leg, the bottom leg being operable to support hangers placed in said space and over the bottom leg; and, an eccentric clamp bar rotatable on an axis located in said common plane and having an elongated eccentric contact member with a lower surface movable to bear against said hangers when placed on the bottom leg, the clamp bar having opposite ends along the axis, the clamp bar and the frame member being journalled together at least at the rear leg of the frame member, the clamp bar being rotatable on said axis in said common plane between an open position, wherein the contact member is spaced from the bottom leg, whereby hangers can be placed on the bottom leg, and a closed position, wherein the contact member is disposed against at least one of the hangers and the bottom leg, whereby the hangers are clamped in place.

2. The clamp for retaining hangers of claim 1, wherein the eccentric clamp bar is journalled to the frame member at a distal end of the top leg.

3. The clamp for retaining hangers of claim 1, further comprising a finger tab for manual rotation of the clamp bar, the finger tab having a lever rigidly connected by a first end thereof to the clamp bar, the lever extending from the axis by a second end accessible to a user for moving the clamp bar between the open and the closed positions.

4. The clamp for retaining hangers of claim 3, wherein the finger tab is connected to the clamp bar at a front end of the clamp bar adjacent the distal end of the top leg of the frame member.

5. A clamp for retaining hangers, comprising:

a rigid frame member having a top leg, a rear leg and a bottom leg defining a general C-shape with a space between the top leg and the bottom leg;

means for mounting the frame to a support such that the bottom leg is spaced below the top leg, the bottom leg being operable to support hangers placed in said space and over the bottom leg;

an eccentric clamp bar rotatable on an axis and having an elongated eccentric contact member with a lower surface at least partly co-extensive with the bottom leg, the clamp bar having opposite ends along the axis, the clamp bar and the frame member being journalled together at the rear leg of the frame member, the frame member having a downward extension at a distal end of the top leg of the frame member, the downward extension defining a partial enclosure for the clamp bar and rotatably supporting a front of the clamp bar, and further comprising a finger tab disposed on an opposite side of the partial enclosure from the contact member of the clamp bar, the finger tab having a lever rigidly connected to the clamp bar for manual displacement by a user in moving the clamp bar between the open and closed positions, the clamp bar being rotatable on said axis between an open position, wherein the contact member is spaced from the bottom leg, whereby hangers can be placed on the bottom leg, and a closed position, wherein the contact member is disposed to retain hangers on the bottom leg.

6. The clamp for retaining hangers of claim 5, further comprising at least one detent on one of the clamp bar and the frame, the detent including means resiliently engaging between the clamp bar and the frame at least at one of said open and closed positions, thereby retaining the clamp bar.

7. The clamp for retaining hangers of claim 6, wherein the detent includes a movable body on one of the clamp bar and the frame, and a depression complementary to said movable body in the other of the clamp bar and the frame for receiving the body, the body and the depression being spaced from the axis of the clamp bar and the body being resiliently urged toward the depression.

8. The clamp for retaining hangers of claim 1, wherein the means for mounting the frame to the support includes at least one wing support attached to and extending from one of the top leg and the rear leg of the frame, the wing support extending at least partly perpendicular to the axis of the clamp bar and having an attachment means spaced from the frame.

9. The clamp for retaining hangers of claim 1, further comprising a resilient pad on at least one of the contact member and the bottom leg, operable to resiliently engage the hangers.

10. The clamp for retaining hangers of claim 9, wherein the pad is provided with depressions for receiving the hangers.

11. A trolley clamp for a garment bag, comprising:

a rigid frame including a lower leg mountable to extend generally forward at a space below a top wall of the garment bag, the rigid frame with the lower leg defining a plane;

a rotatable clamp bar journalled to the frame by at least one end of the clamp bar, the clamp bar having an elongated eccentric protruding portion and being rotatable on an axis in said plane, the clamp bar axis being spaced from the lower leg such that the clamp bar can be rotated on the axis between an open position at which the eccentric protruding portion is spaced from the lower leg, whereby hangers can be placed on the lower leg, and a closed position at which the eccentric protruding portion bears against at least one of the hangers and the lower leg, to clamp the hangers in place.

12. The trolley clamp for a garment bag of claim 11, wherein the frame is a rigid C-shaped body having a top leg and a rear leg in a common plane with the lower leg, and further comprising a mounting plate having at least one wing extending perpendicular to the plane, the wing having fastener means for attaching the frame to a top wall of the garment bag, the mounting plate being rigidly attached to one of the top leg and the rear leg of the frame.

13. A trolley clamp for a garment bag, comprising:

a rigid frame including a lower leg mountable to extend generally forward at a space below a top wall of the garment bag;

a rotatable clamp bar journalled to the frame by at least one end of the clamp bar, the clamp bar having an elongated eccentric protruding portion and being rotatable on an axis in a plane common with the lower leg of the frame and wherein the axis is parallel to the lower leg, the clamp bar axis being spaced from the lower leg such that the clamp bar can be rotated on the axis between an open position at which the eccentric protruding portion is spaced from the lower leg, whereby hangers can be placed on the lower leg, and a closed position at which the eccentric protruding portion bears against at least one of the hangers and the lower leg, to clamp the hangers in place.

* * * * *